United States Patent [19]

Katakabe et al.

[11] Patent Number: 4,558,964

[45] Date of Patent: Dec. 17, 1985

[54] PRINT ELEMENT AND PRINTING APPARATUS USING SAME

[75] Inventors: Noboru Katakabe, Uji; Shuichi Watanabe, Neyagawa; Takehisa Takamiya, Hirakata; Hiroaki Takase, Hirakata; Orio Yoshii, Kadoma, all of Japan

[73] Assignee: Matsushita Electric Industrial Co., Ltd., Kadoma, Japan

[21] Appl. No.: 548,424

[22] Filed: Nov. 3, 1983

[30] Foreign Application Priority Data

Nov. 26, 1982 [JP] Japan ..... 57-207807

[51] Int. Cl.[4] ..... B41J 1/46

[52] U.S. Cl. ..... 400/144.1; 400/257; 400/175; 101/93.15

[58] Field of Search ..... 400/144, 144.1, 144.2, 400/144.4, 145, 145.1, 145.2, 175, 251, 257, 258, 268, 270, 174; 101/93.15, 93.16, 93.17

[56] References Cited

U.S. PATENT DOCUMENTS

| | | | |
|---|---|---|---|
| 2,085,609 | 6/1937 | Schönfelder | 400/174 |
| 4,126,400 | 11/1978 | Suzuki et al. | 400/144.1 |
| 4,338,034 | 7/1982 | Babler | 400/144.2 |

FOREIGN PATENT DOCUMENTS

| | | | |
|---|---|---|---|
| 55-118868 | 9/1980 | Japan | 400/144.2 |
| 57-72863 | 5/1982 | Japan | 400/144.1 |

*Primary Examiner*—Edgar S. Burr
*Assistant Examiner*—David A. Wiecking
*Attorney, Agent, or Firm*—Wenderoth, Lind & Ponack

[57] ABSTRACT

A printing apparatus having a simple construction is constituted by a print element with a plurality of resilient spokes which have type elements disposed vertically thereon and in two rows around the element and extend upwardly from a disc base in a cylinder, and a gear on the disc base integral therewith and coaxial with the disc base and cylinder. The print element is easy to mount and remove. A hammer for pressing each type element on the print element against a printing member and a shaft mechanism for carrying out a shifting operation of the print element are provided. A rotary means includes a motor for rotatably driving the print element and a drive gear connected to the motor. A holder is provided for holding the print element, hammer, and shift mechanism. The print element is preferable mountable and removable with respect to the holder and when mounted, engages the drive gear and is rotatable and vertically movable.

6 Claims, 8 Drawing Figures

PRINT ELEMENT AND PRINTING APPARATUS USING SAME

BACKGROUND OF THE INVENTION

1. Field of the Invention

This invention relates to an impact printer using a print element and to the print element.

2. Description of the Prior Art

An impact printer, such as a typewriter or the like, now generally uses a print element 1 having a daisy wheel-like or a cup-like shape as shown in FIG. 1. The print element 1 in FIG. 1 comprises a disc-shaped base 2, a number of resilient rod-like spokes 3 extending upwardly from the disc and juxtaposed radially or in a cup-like manner, and type elements 4*a* and 4*b* provided in two rows at the upper end of each spoke 3, the base 2 having a center bore 7 into which a center shaft 6 having a mounting portion 5 is insertable so that the print element 1 is detachably mountable on the mounting portion 5 and a positioning bore 9 into which a positioning pin 8 is insertably fitted. The mounting portion 5 for the print element 1 is often connected directly to a motor shaft 10. But in some cases, it is provided on a rotary member which is connected to the motor shaft 10 by gears or the like to reduce the rotational speed in order to match the inertia of print element 1 with that of the rotor of the motor 11. In any case, the print element 1 and the rotary member having the mounting portion 5 should be aligned with each other with accuracy. Hence, it is troublesome and takes much time to exchange the print element 1 for the reason that the print element 1, when mounted, is limited as to its position and inevitably must be mounted or removed from above, and a printing hammer may escape from the position shown in the drawing during the exchanging of the print element 1.

Also, a shift mechanism 15, comprising a rotary solenoid 13 and a cam lever 14 or the like and used for vertically moving the print element 1, must be disposed outside the print element 1, so that it is difficult to make the printing small-sized.

SUMMARY OF THE INVENTION

An object of the invention is to provide a print element which has a simple and compact print element drive mechanism on which it is extremely easy to mount the print element and from which it is easy to remove the print element.

Another object of the invention is to provide a printing apparatus having a shift mechanism which is small-sized and has high reliability and utilizes the internal space in the print element.

The print element and the printing apparatus of the invention comprises a plurality of resilient spokes juxtaposed cylindrically around the disc base and having first and second type elements in two rows at the upper ends of the spokes respectively, and a gear portion provided coaxially and integrally with the disc base. The print element can be used to simplify and miniaturize the print element drive mechanism and dismounting of the print element.

The above and other objects and features of the present invention will become apparent from considering the following description taken in connection with the accompanying drawings in which:

DESCRIPTION OF THE PREFERRED EMBODIMENTS

Next, an embodiment of the invention will be described in connection with the accompanying drawings.

Figure 1:
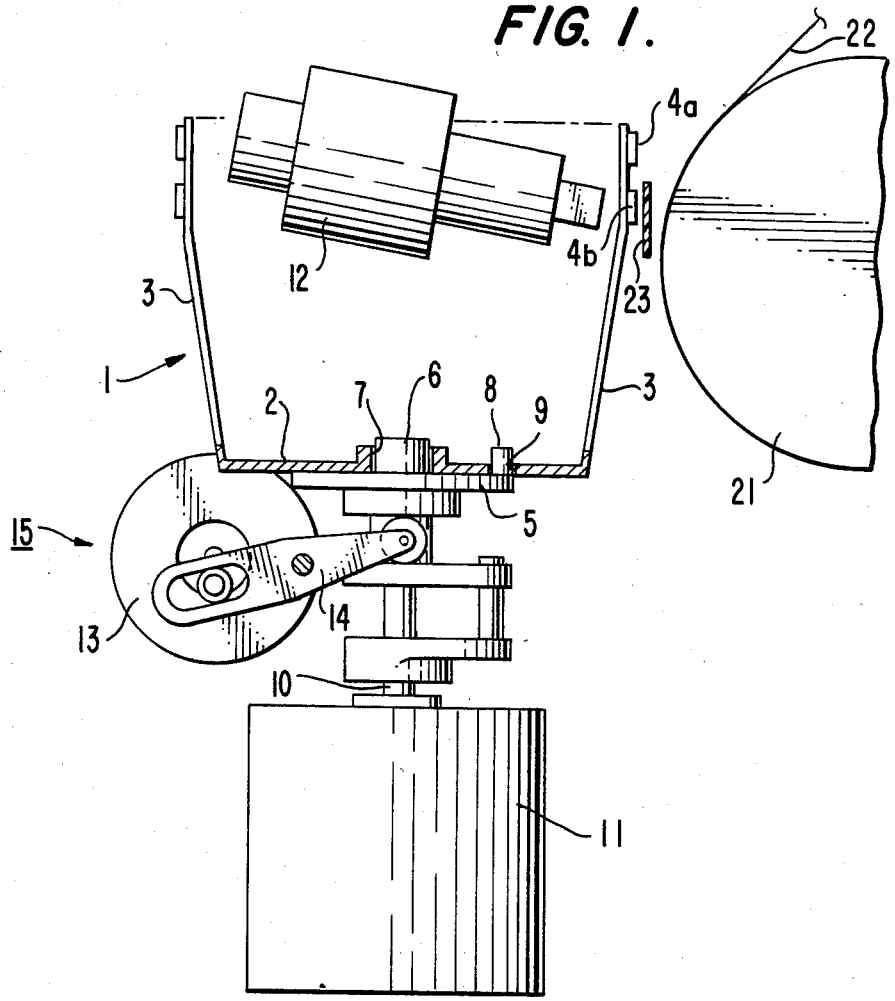
FIG. 1 is a partially cutaway side view of the principal portion of a conventional printing apparatus.
Figure 2:
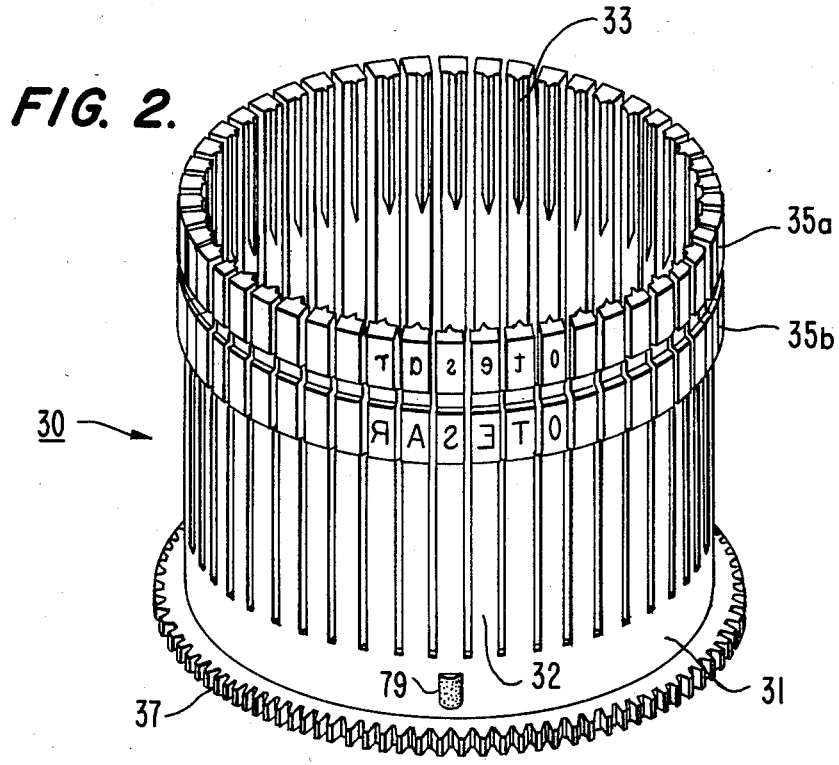
FIG. 2 is a perspective view of a print element of this invention.
Figure 3:
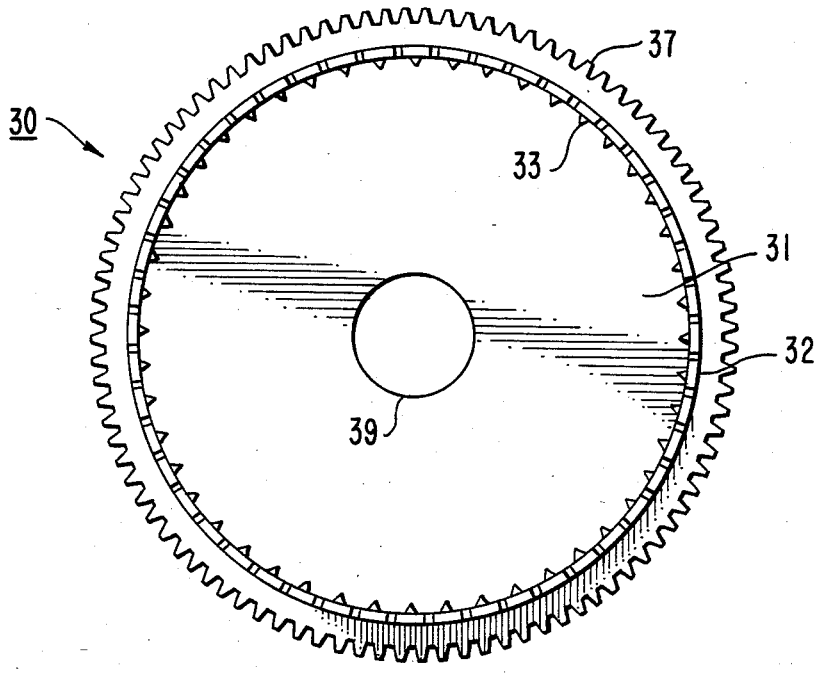
FIG. 3 is a plan view of the print element of FIG. 2 when viewed from above.
Figure 4:
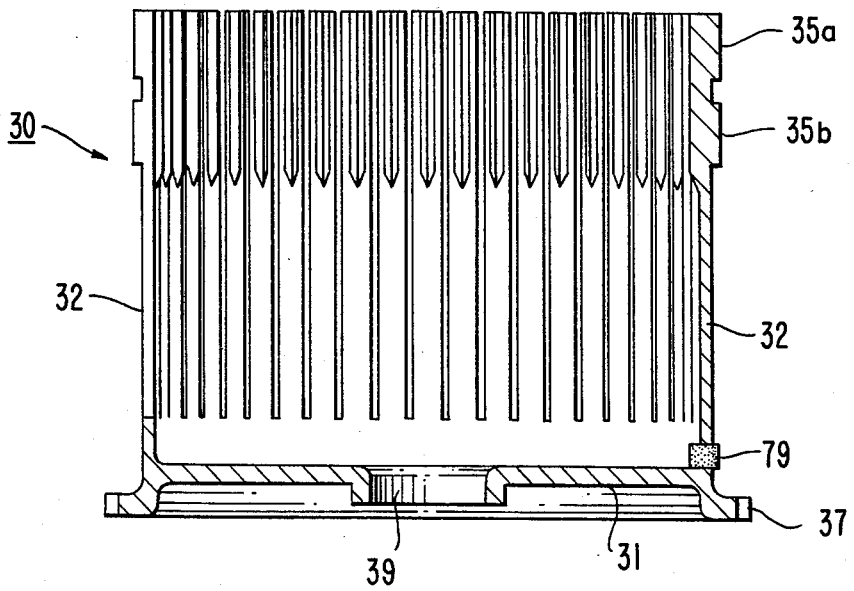
FIG. 4 is a sectional front view of the same.

In FIGS. 2–4, reference numeral 31 designates a disc-shaped base of print element 30, and in the vicinity of the circumference of the upper surface of base 31 are forty-eight upwardly extending spokes 32 cylindrically spaced at regular intervals around the disc and integral with the disc base 31 and forming a cylindrical shape coaxial with an axis through the center of the base. Type elements 35*a* 35*b* are disposed vertically at the upper end of each spoke 32 and are in two circumferential rows around the outside of the spokes 32. There are 48 spokes and $48\times2=96$ type elements 35*a* and 35*b*. The spokes 32 each are bendable outwardly from the cylindrical shape, and a spur gear 37 concentric with the disc-shaped base 31 is provided on the outer periphery of lower surface of base 31, the gear teeth being all around the circumference of base 31. There are 96 teeth on the gear 37 which is two times the number of spokes 32.

At the center of base 31 is provided a center bore 39 by which the disc base 31 is mounted on a drive mechanism of the printing apparatus, and the base 31, spokes 32, type elements 35*a* and 35*b*, and gear portion 37, are integral with each other, for example by being molded of a synthetic resin, such as polyamid resin or polyacetal resin.

Figure 5:
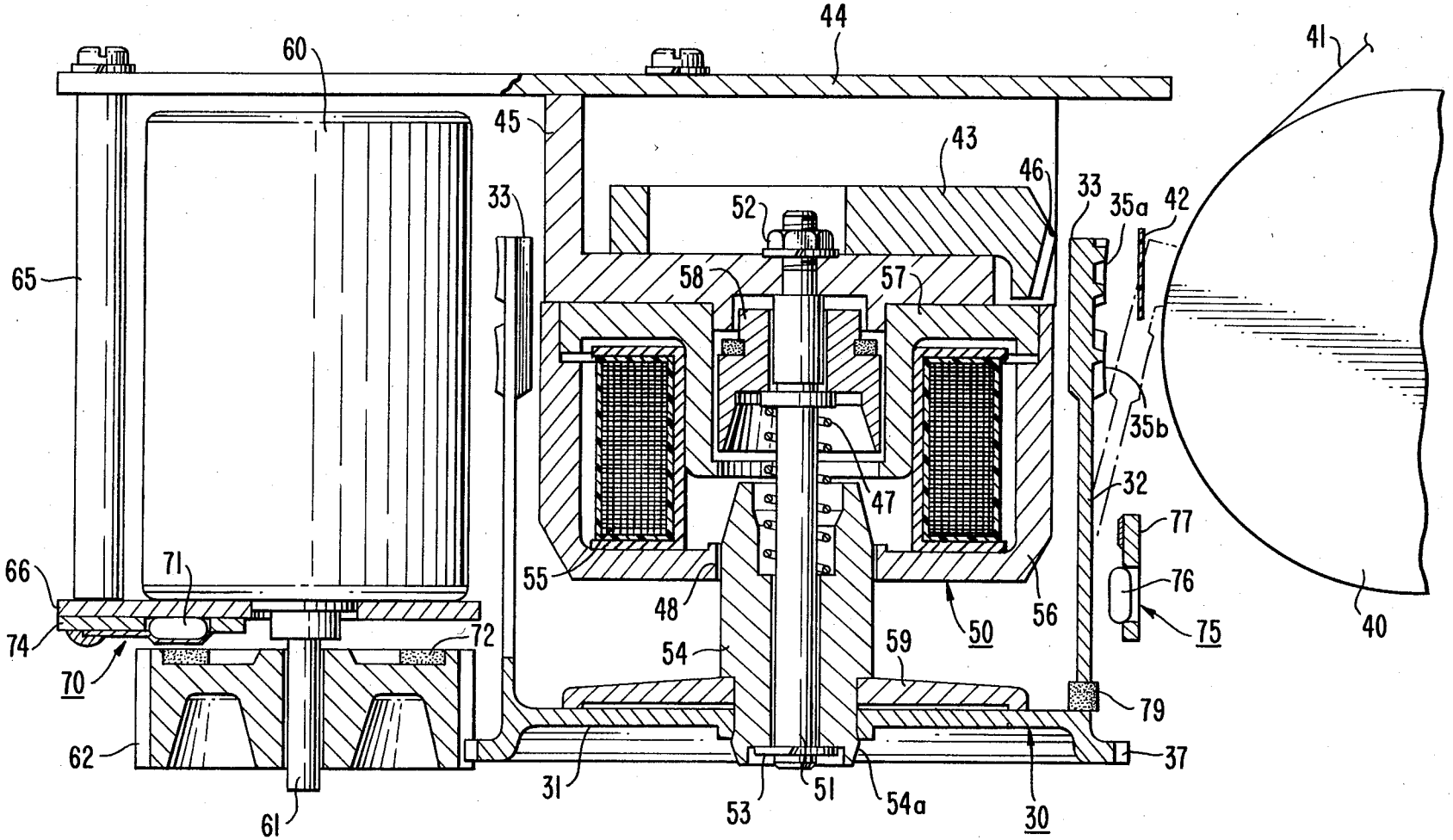
FIGS. 5 and 6 are sectional side views of the principal portion of an embodiment of a printing apparatus of the invention using the print element of FIG. 2, with parts shown in the respective operating conditions.

FIG. 5 is a sectional view of an embodiment of a printing apparatus of the invention using the above print element 30, showing the print element 30 mounted on the printing apparatus and in the lower or vertically unshifted position.

In FIG. 5, reference numberal 30 designates the print element shown in FIG. 2, 40 designates a platen for holding a printing paper (recording paper) 41,42 designates a print ribbon, and 43 designates a print hammer for pressing the type element 35*a* (or 35*b*) onto the printing paper 41 through the print ribbon 42, the hammer 43 being guided by a hammer guide 45 fixed to a support 44 and subjected to an actuating force from a hammer actuating mechanism (not shown) to be moved toward the platen 40. A V-shaped groove 46 is provided at the outer end of print hammer 43 so that when the printing hammer 43 is actuated, the groove 46 engages over a projection 33 having a triangular cross-section and provided on the rear of each type element 35*a* (or 35*b*) to thereby carry the type element 35*a* (or 35*b*) to the platen-engaging position and strike the type element against the printing paper in an accurate printing position.

A support shaft 51 is fixed by a nut 52 to the center of hammer guide 45 fixed to the support 44 and rotatably and vertically movably supports a plunger 54 of a shifting solenoid 50, the plunger 54 being normally biased downwardly by a coiled spring 47 until the plunger 54 strikes a stop 53. The shifting solenoid 50 comprises, other than the plunger 54, a coil 55 for generating the magnetic flux, yokes 56 and 57 for forming the magnetic path, and a rotor 58. The rotor 58 is rotatably mounted on the upper portion of support shaft 51, the yoke 57 being fixed to the support shaft 51 coaxially therewith and under the hammer guide 45 and opposed to the rotor 58 with a predetermined space therebetween. The yoke 56 is press-fitted onto the yoke 57 and bored 48 at the center of the bottom, the bore 48 having a size to pass the plunger 54 with a small clearance, the yokes 56 and 57 forming an inner space holding therein the coil 55. In addition, the yokes 56 and 57, rotor 58 and plunger 54 are made of soft magnetic material, such as soft iron, of high permeability in order to form the magnetic path, the hammer guide 45 and support shaft 51 being made of non-magnetic material.

A tapered projection 54*a* is provided at the lower portion of plunger 54 and the print element 30 is clamped between the upper surface of the tapered portion 54*a* and a holding plate 59 press-fitted onto the plunger 54.

The vertical position of the print element 30 is adjusted so that the upper type element 35*a* is positioned in front of print hammer 43 and pressed onto the platen 40 when the parts are as shown in FIG. 5 with the shifting solenoid deenergized.

A motor 60 is fixed to a motor mounting plate 66 fixed to the support 44 by a plurality of stays 65 and beside print element 30, a drive gear 62 being press-fitted onto the motor shaft 61 and engaging with the spur gear 37 on the print element 30 thereby transmitting the rotating force from the motor 60 to the print element 30.

Figure 6:
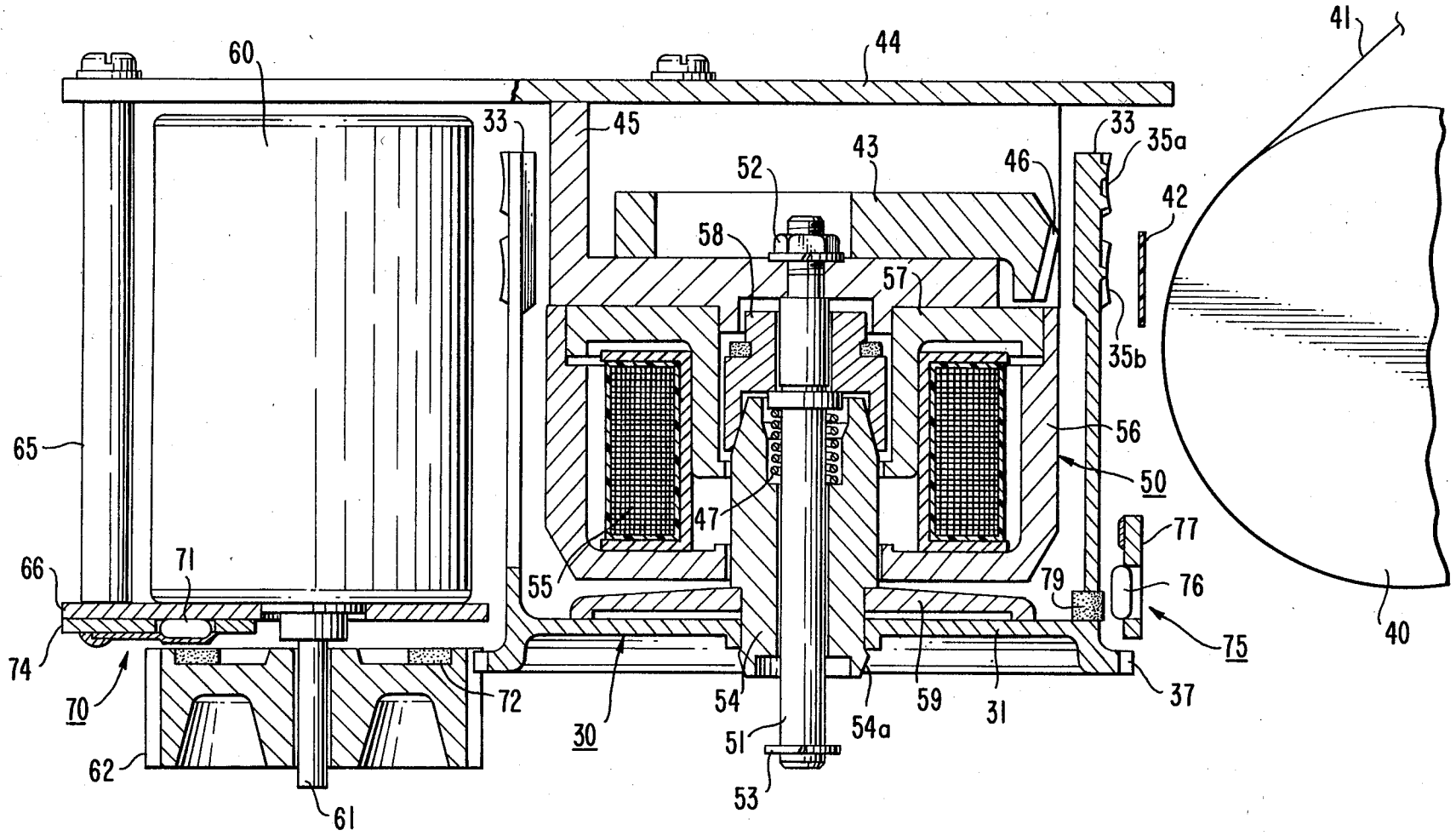

FIG. 6 is a sectional view of the FIG. 5 embodiment showing the parts in positions occupied when the coil 55 of the shifting solenoid 50 is energized and the plunger 54 is attracted by the electromagnetic force to the rotor 58 so that the print element 30 is shifted upwardly. In FIG. 6, the plunger 54 is set to move a distance so that the lower type element 35*b* is positioned in front of print hammer 43 so as to be pressed against the platen 40. The face width (thickness) of drive gear 62 is large enough to accommodate this amount of shift of print element 30, so that even when the print element 30 is shifted upwardly, the gear 37 thereof will be kept in engagement with the drive gear 62.

The number of teeth on drive gear 62 is 48, half the number on gear 37, so that the print element 30 is driven at reduced speed to decrease the equivalent inertia at the motor shaft 61 for the print element 30 and the load side inertia is allowed to approach the point where the inertia on the load side becomes equal to that on the drive side, thereby reducing energy required from the motor 60.

As seen from FIGS. 5 and 6, the print hammer 43 and shifting solenoid 50 are mounted on the support 44 above the print element 30 and disposed within the internal space in the print element 30, the print element 30 being adapted to be freely mounted on or removed from the plunger 54 from below.

Next, an explanation will be given of a position detector for the type elements.

In FIGS. 5 and 6, reference numeral 70 designates a position detection means comprising a position detector 71 on motor mounting plate 66 and an annular permanent magnet 72 on a member the position of which is to be detected, here the gear 62, and 75 designates an origin detection means comprising an origin detector 76 and a square permanent magnetic piece 79 on print element 30.

Figure 7:
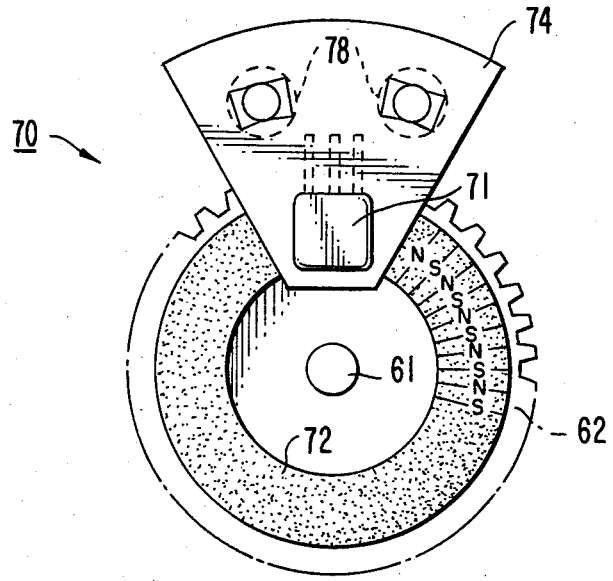
FIG. 7 is a top view of the principal portion of position detection means shown in FIGS. 5 and 6.

FIG. 7 is a top view of part of the position detection means 70 shown in FIGS. 5 and 6, from which the motor mounting plate 66 is removed.

The permanent magnet 72 is magnetized at the surface thereof opposed to the position detector 71 and fixedly mounted on the drive gear 62 and rotatable integrally with the motor shaft 61, the magnetized surface being divided equally into 48 pairs of poles (the pairs being alternate N-poles and S-poles) around the circumference. The position detector 71 is a magnetic sensor made of a magnetoresistor and fixed to a mounting plate 74 and opposed to the permanent magnet 72 with a slight gap therebetween, the mounting plate 74 being fixed to the motor mounting plate 66 by set screws 78 and adapted to shift somewhat in a direction around the motor shaft 61 to thereby enable adjustment of the position thereof.

The origin detector 76 is a magnetic sensor comprising a magnetoresistor the same as the position detector 71 and is adapted to detect the magnetic field generated by the permanent magnetic piece 79. The magnetic piece 79 is fixed to the lateral side of print element 30 and mounted at a position opposed to the origin detector 76 with a slight gap therebetween as shown in FIG. 6 when the print element 30 is shifted.

Also, the origin detector 76 is fixed to a mounting plate 77 which is fixed to the support 44 by a mounting part (not shown).

Figure 8A:
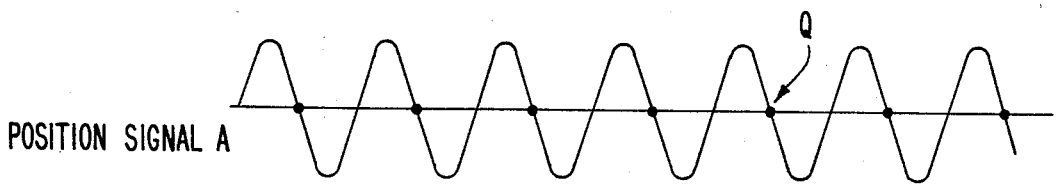
FIGS. 8*a* and *b* are waveform charts of a position signal and an origin signal.
Figure 8B:
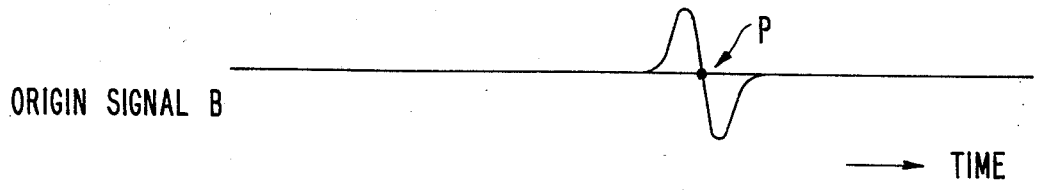

FIGS. 8*a* and 8*b* show position signal waveforms obtained from the position detector 71 and origin detector 76, in which the position signal A is a waveform of 48 cycles (corresponding to the number of pairs of poles on the permanent magnet 72) per one rotation. The origin signal B obtained from the origin detector 76 is generated when the permanent magnetic piece 79 provided on the print element 30 passes the origin detector 76, and the origin detector 76 outputs only one pulse at the specified position each time the print element 30 fully rotates. A drive control circuit (not shown) normally recognizes the rotational position of print element 30 by means of the incremental method using the position signals A and B and after the motor 60 is rotated to the predetermined position the position signal A is used to position the motor shaft 61 at a predetermined position. This is a generally used method so that a further explanation is omitted.

The motor shaft 61 can be stopped by the position control method at the zero-cross-point of every one cycle period shown by the black dot on the waveform of position signal A in FIG. 8*a*, each zero-cross-point dividing one rotation of motor shaft 61 equally into 48 parts. Accordingly, the print element 30, which is driven at ½ the speed of motor 60 from the motor shaft 61, will stop at each point where a print element carrying spoke 32 is located after two cycles of signal A. Since the type elements 35*a* and 35*b* are disposed at the points where the circumference of print element 30 is divided equally into 48 parts, two cycles of position signal A will correspond to one pitch of type element 35*a* or 35*b*.

In addition, in order to accurately position the type elements 35*a* and 35*b* just in front of the print hammer 43 when the motor shaft 61 stops at each stationary position corresponding to two cycles of position signal A, the position of mounting plate 74 for the position detector 71 is adjustable.

Next, an explanation will be given of the operation of the embodiment shown in FIGS. 5 and 6.

In a case where the type element 35*a* in the upper row is to print, the parts are in the positions of FIG. 5, and when a print signal is given from a keyboard or the like, the aforesaid drive control circuit computes the rotational position of the desired type element from the present position of print element 30 and rotates the motor 60 only the predetermined angle and thereafter stops it. As a result, the type element 35*a* with the character to be printed is kept positioned in front of the printing hammer 43. When the print element 30 is stationary, a hammer drive mechanism (not shown) starts its operation, the printing hammer 43 projects toward the platen 40, the V-like groove 46 at the outer end of printing hammer 43 engages over the projection 33 on the inside of the type element 35*a*, the spoke 32 is bent against its own resiliency following the projecting motion of printing hammer 43, and the type element 35*a* is pressed onto the printing paper 41 through a print ribbon 42, thus carrying out the printing. After the printing, the printing hammer 43 returns to the original stationary position and the type elements 35*a* and 35*b* also return to the initial condition because the spoke 32 returns to the initial position, thereby enabling the subsequent rotation.

Next, when a new print signal is given, the aforesaid operation is repeated for printing. During the printing, the printing paper 41 moves relative to the support 44 supporting the print element 30 and printing hammer 43, whereby the printing is carried out at a new position on the printing paper 41.

Next, an explanation will be given of the operation when a lower type element 35*b* is to be printed. Upon being given the print signal, the coil 55 of the shifting solenoid 50 at first is energized. A magnetic flux is generated by the coil 55 through the yokes 56 and 57, rotor 58 and plunger 54, so that the plunger 54 is raised against the spring force of coil spring 47 and reaches the position where the plunger 54 contacts the rotor 58. As a result, the lower type element 35*b* is shifted to a position in front of printing hammer 43, at which time the gear 37 slides upwardly while remaining in engagement with the drive gear 62 and still remains in engagement at the shifted position. Upon completing the shifting motion, the motor 60 starts rotation and the drive force therefrom is transmitted to the print element 30 through the drive gear 62 and gear 37, thereby rotating the print element 30, thus repeating the printing operation similar to that with the parts in the above-described unshifted operation. Upon completing the printing, the coil 55 is deenergized and the rotor 58 and plunger 54 are no longer attracted, whereby the plunger 54 is returned to the original position shown in FIG. 5 by the spring force of coiled spring 47.

In addition, the aforesaid shift operation and rotation of motor 60 can be performed simultaneously.

Next, an explanation will be given of the operation to remove the print element 30 from the plunger 54 and replace it.

For an exchange of print element 30, at first the printing apparatus is deenergized and then the gear 37 on the print element 30 is grasped by an operator's hand and pulled downwardly. Since the inner peripheral portion of center bore 39 of the print element 30 is somewhat resilient, this facilitates removal thereof.

Next, a new print element 30 is mounted on the plunger 54, the print element 30 being inserted upwardly keeping above the type elements 35*a* and 35*b*. In addition, the yoke 56 is tapered at the outer periphery of the lower end to form a guide for facilitating insertion of print element 30. Lastly, the tapered portion 54*a* on the plunger 54 is mated with the center bore 39 in the print element 30 and the gear 37 engages with the drive gear 62 as the print element 30 is pushed upwardly. Hence, the center bore 39 is fitted onto the plunger 54 over the tapered portion 54*a* thereof, whereby the print element 30 is fixed between the tapered portion 54*a* of plunger 54 and the holder 59. At this time, the engaging position of drive gear 62 with the gear 37 on the print element 30 is not limited to the specified position but may be optional because the position of print element 30 is recognized after the print element 30 is mounted.

Upon completion of the exchange of print element 30, the printing apparatus is energized to actuate the aforesaid drive control circuit and sense the rotational position of print element 30, so that the initial setting operation is carried out in the following order: At first the coil 55 is energized to shift the print element 30 and then the motor 60 rotates one or more times at constant speed. Since the print element 30 is shifted, the permanent magnet piece 79 mounted on the print element 30 passes the front of origin detector 76, from which the origin signal B in FIG. 8*b* is obtained. At this time, since the motor 60 rotates, the position detector 71 produces the position signal A as shown in FIG. 8*a*. The two positional information signals cause the drive control circuit to recognize the rotational position of print element 30 by use of the known method, and thereafter the print element 30 is stopped at the predetermined position. Subsequently, the coil 55 is deenergized and the print element 30 returns downwardly, thereby completing the initial setting operation to put the printing apparatus in condition for receiving the print signal.

In addition, in this embodiment, when the motor 60 stops at the point Q (see FIG. 8*a*) of the position signal A just after the point P on the origin signal B shown in FIG. 8*b* is obtained, the stop position of motor 60, position of print element 30 and that of origin signal B are related with each other so that the underlined type elements are positioned in front of printing hammer 43 to be kept in a stand-by condition.

Further, in this embodiment, the circumference of the motor shaft 61 is divided into 48 equal pitches, and the motor shaft 61 can stop at any of the 48 positions equally dividing the circumference thereof. Since the rotation ratio of the driving gear 62 and the gear portion 37 is 2:1, the print element 30 can stop at 96 positions during one rotation thereof corresponding to two rotations of the motor shaft 61. The type unit of the print element 30 has 48 type columns. This means that two pitches of the motor shaft 61 correspond to one pitch of a type column. Therefore, if a specified type element 35*a* or 35*b* is initially positioned just in front of the printing hammer 43 when the motor shaft 61 is at one of its stop positions and if the motor shaft 61 is turnable two pitches thereof for each type element position, all of the other type elements on the print element 30 can be positioned just in front of the printing hammer 43.

As described above, the number (M) of stopping positions of the print element 30 must be equal to or an integral multiple of the number (S) of type columns on the type element 30. This condition is expressed as:

$$M=n_1 \cdot S \quad (1)$$

where $n_1$ is any positive integer. If this condition is not satisfied, all of the type elements can not be placed at their correct positions.

On the other hand, the number (Z) of the teeth of the gear 37 is 96, which is equal to the number (M) of stopping positions of the print element 30. Therefore, if the gear 37, when the print element 30 is mounted, is engaged with any portion of the driving gear 62, the positions of the type elements coincide with the stopping positions of the print element 30 determined by stop positions of the motor 60. Accordingly, by rotating the print element 30 after it is mounted, the rotating position of the print element 30 is recognized by signals from origin detector 76 and position detector 71 thereby to initially position the print element 30. After this initial positioning, all the type elements of the print element 30 will be placed at their correct printing positions. The number(Z) of the teeth of the gear 37 is 96 in this embodiment, but it may be 48 or 24 so as to obtain the same result as above. That is, the gear 37 may be engaged with the driving gear 62 so that a particular point of the print element 30 is coincident with the point which divides the circumference of the print element 30 into M parts. In other words, this condition is expressed by the following equation:

$$Z=(1/n_2) \cdot M \quad (2)$$

where $n_2$ is a positive integer.

As described above, the print element of the invention is constructed in such a way as to satisfy the above described equations (1) and (2), so that the print element can be easily mounted in any position on the print apparatus without considering the positional relation between the gear of the print element and the driving gear.

Further, in this embodiment, a DC motor is used as the motor 60, and the start and stop operations of the DC motor are controlled by the combination of the position detecting means 70 and the DC motor. But a stepping motor may also be used as the motor 60 so as to achieve the above described effects.

As seen from the above, the print element and the printing apparatus of the invention, which has the conventional cup-like shaped print element integral with the gear for driving the print element, simplifies the print element drive mechanism; the mounting of the print element is only by engagement of drive gear with the gear of the print element; and can achieve with ease the speed reduced drive to match the inertia of the motor's rotor with that of the load.

Also, the shift mechanism is disposed within the print element which forms a compact printing apparatus. The print element is mountable or removable from below without moving the printing hammer, shifting solenoid, etc., and the print element is mounted or removed extremely easily because its mounting position is not limited.

Although a preferred embodiment of the invention has been described using specific terms, such description is for illustrative purpose only, and it should be understood that changes and variations may be made without departing from the spirit or scope of the following claims.

What is claimed is:

1. A printing apparatus comprising:

a print element having;

a disc-shaped base at a base end of said print element, said base having an axis of rotation through the center thereof perpendicular to the base, a plurality of resilient spokes extending perpendicularly from said base, said spokes being arranged in a cylinder coaxial with said axis of rotation and each having a base end attached to said base and a free end on the other end from said base end, each of said plurality of resilient spokes having two type elements on the surface thereof near the free end thereof which faces outwardly of said axis of rotation, and a gear integral with said base and coaxial with said axis of rotation, the diameter of said gear being larger than the diameter of said cylinder;

means for rotating said print element around said axis of rotation to printing positions among a plurality of circumferential printing positions, and having a motor and a motor gear driven by said motor and engaged with said gear of said print element for rotating said print element for bringing a desired one of said plurality of resilient spokes into a printing position;

shift means connected to said print element for moving said print element along the rotational axis of said print element for bringing a desired one of the two type elements on a spoke into a printing position;

hammer means for engaging the spoke at the printing position and forcing the type element thereon against a printing medium; and support means on which said shift means and said hammer means are supported, said support means being adjacent the end of the print element corresponding to the free ends of said spokes for supporting said shift means and said hammer means in the space within the cylinder from said end of said print element, whereby said print element can be detached from and attached to said shift means from the direction of the base end of the print element without displacing said shift means or said hammer means.

2. A printing apparatus as claimed in claim 1 wherein said motor has a plurality of stopping positions corresponding to the circumferential printing positions of said print element, the number M of said circumferential printing positions being according to the formulas:

$$M=n_1 \cdot S,$$

and $$Z=(M/n_2)$$

where S is the number of spokes on said print element, Z is the number of teeth on said gear, and $n_1$ and $n_2$ are positive integers.

3. A printing apparatus as claimed in claim 1 wherein said shift means comprises a plunger mounted on said support means for rotation around and axial movement in the direction of said axis of rotation, and a coil around said plunger for generating a magnetic flux for moving said plunger in the axial direction, said print member being detachably mounted on said plunger, and said plunger being rotatable relative to said coil both when said coil is energized and when it is deenergized.

4. A printing apparatus comprising:

a print element having;

a disc-shaped base at a base end of said print element, said base having an axis of rotation through the center thereof perpendicular to the base, a plurality of resilient spokes extending perpendicularly from said base, said spokes being arranged in a cylinder coaxial with said axis of rotation and each having a base end attached to said base and a free end on the other end from said base end, each of said plurality of resilient spokes having two type elements on the surface thereof near the free end thereof which faces outwardly of said axis of rotation, and a gear integral with said base and coaxial with said axis of rotation, the diameter of said gear being larger than the diameter of said cylinder;

means for rotating said print element around said axis of rotation to printing positions among a plurality of circumferential printing positions, and having a motor and a motor gear driven by said motor and engaged with said gear of said print element for rotating said print element for bringing a desired one of said plurality of resilient spokes into a printing position, said motor and motor gear being beside said print element laterally of said print element and said gear being movable axially away from said motor gear;

shift means connected to said print element for moving said print element along the rotational axis of said print element for bringing a desired one of the two type elements on a spoke into a printing position;

hammer means for engaging the spoke at the printing position and forcing the type element thereon against a printing medium; and support means on which said shift means and said hammer means are supported, said support means being adjacent the end of the print element corresponding to the free ends of said spokes for supporting said shift means and said hammer means in the space within the cylinder from said end of said print element, whereby said print element can be detached from and attached to said shift means from the direction of the base end of the print element without displacing said rotating means, said shift means or said hammer means.

5. A printing apparatus as claimed in claim 4 wherein the axis of rotation of said motor is parallel to the axis of rotation of said print element, and said gear is slidable along said motor gear.

6. A printing apparatus as claimed in claim 4 wherein said motor has a plurality of stopping positions corresponding to the circumferential printing positions of said print element, the number M of said circumferential printing positions being according to the formulas:

$$M=n_1 \cdot S,$$

and $$Z=M/n_2$$

where S is the number of spokes on said print element, Z is the number of teeth on said gear, and $n_1$ and $n_2$ are positive integers.

* * * * *